US005990798A

United States Patent [19]

Sakai

[11] Patent Number: 5,990,798

[45] Date of Patent: Nov. 23, 1999

[54] ATOMIC ABSORPTION PHOTOMETER WITH A SAFETY MONITOR

[75] Inventor: Masumi Sakai, Kyoto, Japan

[73] Assignee: Shimadzu Corporation, Kyoto, Japan

[21] Appl. No.: 09/211,908

[22] Filed: Dec. 15, 1998

[30] Foreign Application Priority Data

Dec. 19, 1997 [JP] Japan ..... 9-351387

[51] Int. Cl.[6] ..... G08B 17/10

[52] U.S. Cl. ..... 340/632; 340/634; 431/24

[58] Field of Search ..... 340/577, 605, 340/611, 626, 632, 633, 634, 439; 110/246, 346; 241/31, 33; 431/24, 29, 18

[56] References Cited

U.S. PATENT DOCUMENTS 4,518,345 5/1985 Mueller et al. ..... 431/24
4,778,113 10/1988 Jewett et al. ..... 241/31
4,846,410 7/1989 Jewett et al. ..... 241/31
5,055,825 10/1991 Yang ..... 340/439
5,207,176 5/1993 Morhard et al. ..... 110/246
5,522,541 6/1996 Zia et al. ..... 236/10

*Primary Examiner*—Jeffery A. Hofsass
*Assistant Examiner*—Van T. Trieu
*Attorney, Agent, or Firm*—Majestic, Parsons, Siebert & Hsue P.C.

[57] ABSTRACT

An atomic absorption photometer includes a microprocessor which is programmed so as to affirmatively create an unsafe condition by lowering the pressure inside the flow route of a combustion improving gas and to check if the gas switch in this flow route indicates this unsafe condition. If it is found that this unsafe condition is not being indicated by the switch, a warning signal is outputted and the use of flame by the photometer is prevented.

8 Claims, 2 Drawing Sheets

ATOMIC ABSORPTION PHOTOMETER WITH A SAFETY MONITOR

BACKGROUND OF THE INVENTION

This invention relates to atomic absorption photometers and more particularly to atomic absorption flame photometers which use a flame generated by burning a gas to atomize a sample.

Such an atomic absorption flame photometer typically uses a burner to subject a sample to a burning process by generating a flame above a slot provided to a burner head. A mixture of a combustion gas and a combustion improving gas is usually burnt together to generate a flame. Examples of combustion gas include acetylene ($C_2H_2$), and examples of combustion improving gas include air and $N_2O$. An atomic absorption flame photometer is usually provided with a safety device for monitoring whether the burning of the flame is proceeding safely or not. Examples of such a device include gas pressure monitors.

Gas pressure monitors are for monitoring the pressure of the gas which is being supplied so as either to prevent the use of a flame if the gas pressure becomes low or to automatically shut off the supply of gas in the midst of a combustion process and to extinguish the flame safely.

If such a monitor malfunctions, and in particular if the malfunctioning is such that the monitor would regard an unsafe condition as being safe, the situation is very serious because the safety device is not functioning as such. The cause of a malfunctioning may be electrical in nature such as a broken cable or an imperfect connection by a connector. In the case of a gas pressure monitor, it may be due to a mobile part of the pressure switch getting stuck somewhere.

Prior art attempts at preventing accidents due to such malfunctions included using a more reliable and hence more expensive monitor and using two or more sensors. All these methods were costly, causing an increase in the production cost of the monitor.

SUMMARY OF THE INVENTION

It is therefore an object of this invention to provide an atomic absorption photometer with a safety monitor which uses a single inexpensive sensor but does not malfunction and is dependable.

An atomic absorption photometer embodying this invention, with which the above and other objects can be accomplished, may be characterized as including not only a safety monitor but also a control mechanism which serves to automatically create an unsafe condition and either to ascertain that the safety monitor has detected this unsafe condition and hence is functioning properly or to stop the use of a flame if it is detected that the safety monitor is not functioning properly.

If the safety monitor is a gas pressure monitor, the control unit may function to exhaust the gas to create a low-pressure condition prior to the lighting of a flame and include means for checking whether the safety monitor detects this affirmatively created unsafe condition. If the control unit discovers that the safety monitor failed the test, it then serves to prohibit the use of a flame, concluding that the safety monitor is not functioning properly.

Gas pressure monitors usually use a pressure switch as the sensor. While the gas is in a pressured condition, this switch is activated and its output signal keeps changing. If no variations are observed in the output signal, the sensor may be adjudged to be malfunctioning. Thus, prior to the lighting of a flame, the photometer serves to automatically cause the gas to be exhausted first and then to supply the gas again in order to test the operation of the gas pressure monitor. If it is thereby ascertained that the sensor is functioning correctly, the use of a flame is permitted, and a lighting operation is subsequently undertaken. If it is ascertained that the sensor is not functioning properly, a display may be made to this effect, and the use of a flame is prevented until the proper functioning of the sensor is observed in a subsequent similar testing.

By operations as described above, normal operations of a safety monitor can be ascertained even with a relatively inexpensive safety monitor using only one sensor.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
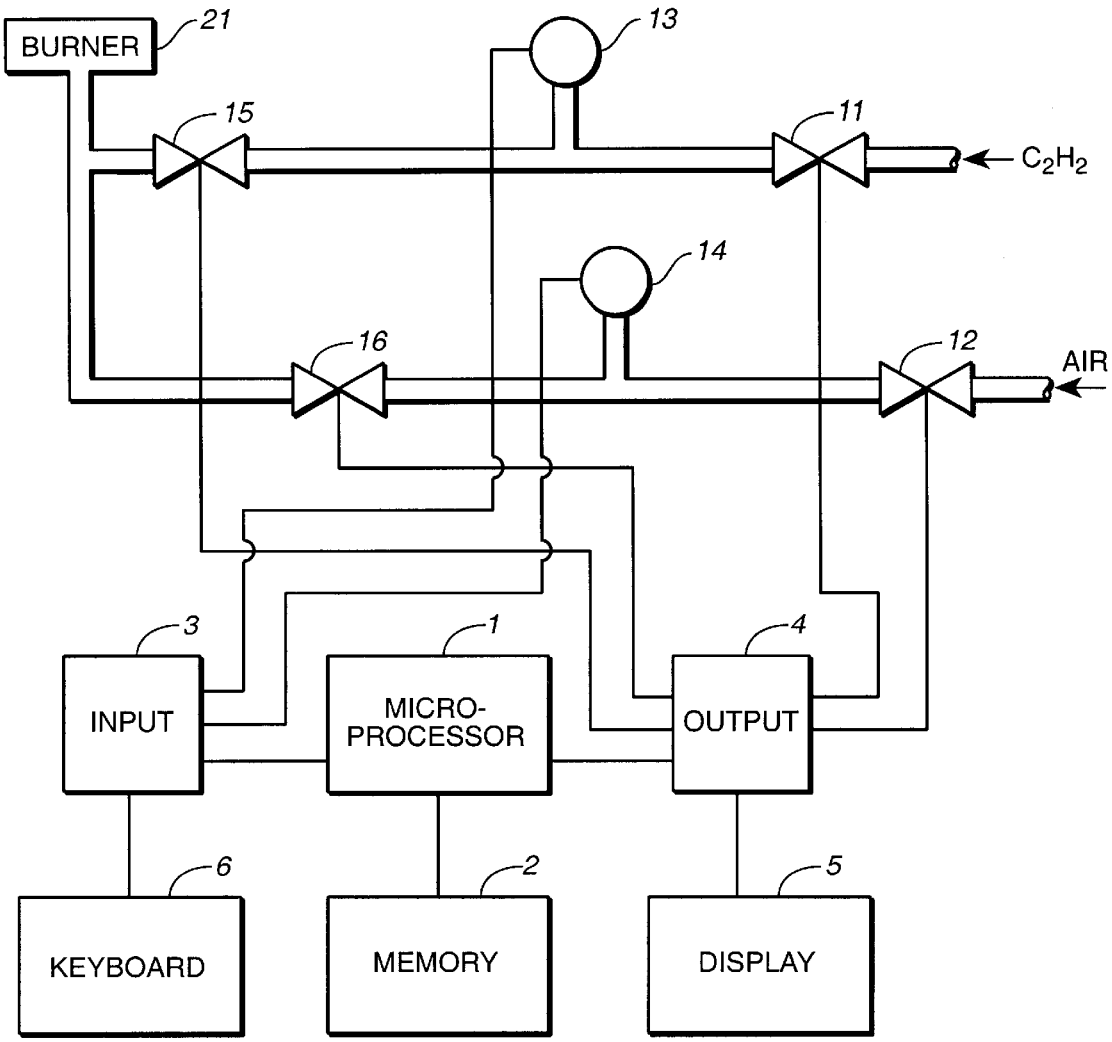
FIG. 1 is a schematic block diagram of an atomic absorption photometer embodying this invention.

The invention is described next by way of an example. FIG. 1 shows the structure of an atomic absorption photometer embodying this invention, numeral 1 indicating a microprocessor, numeral 2 indicating a memory device for storing a program for its operation as well as data on the condition of the apparatus, numerals 3 and 4 indicating respectively an input circuit and an output circuit for the microprocessor 1, numeral 5 indicating a display device for displaying messages and the like, and numeral 6 indicating a keyboard through which the user operates the photometer. A multi-purpose computer may be used for these purposes. FIG. 1 further shows an electromagnetic inlet valve 11 for a combustion gas (such as $C_2H_2$), an electromagnetic inlet valve 12 for a combustion improving gas such as air, a pressure switch 13 for the combustion gas, another pressure switch 14 for the combustion improving gas, an electromagnetic outlet valve 15 for the combustion gas, and an electromagnetic outlet valve 16 for the combustion improving gas, attached to pipes 17 and 18 respectively for the combustion gas and the combustion improving gas, as shown. These electromagnetic valves 11, 12, 15 and 16 are adapted to be opened and closed by a signal outputted from the microprocessor 1. Components which are commonly used in ordinary atomic absorption photometers, such as a flow rate adjusting device, an ignition mechanism, a sample inlet and an optical system, are omitted in FIG. 1 for the convenience of disclosure.

Figure 2:
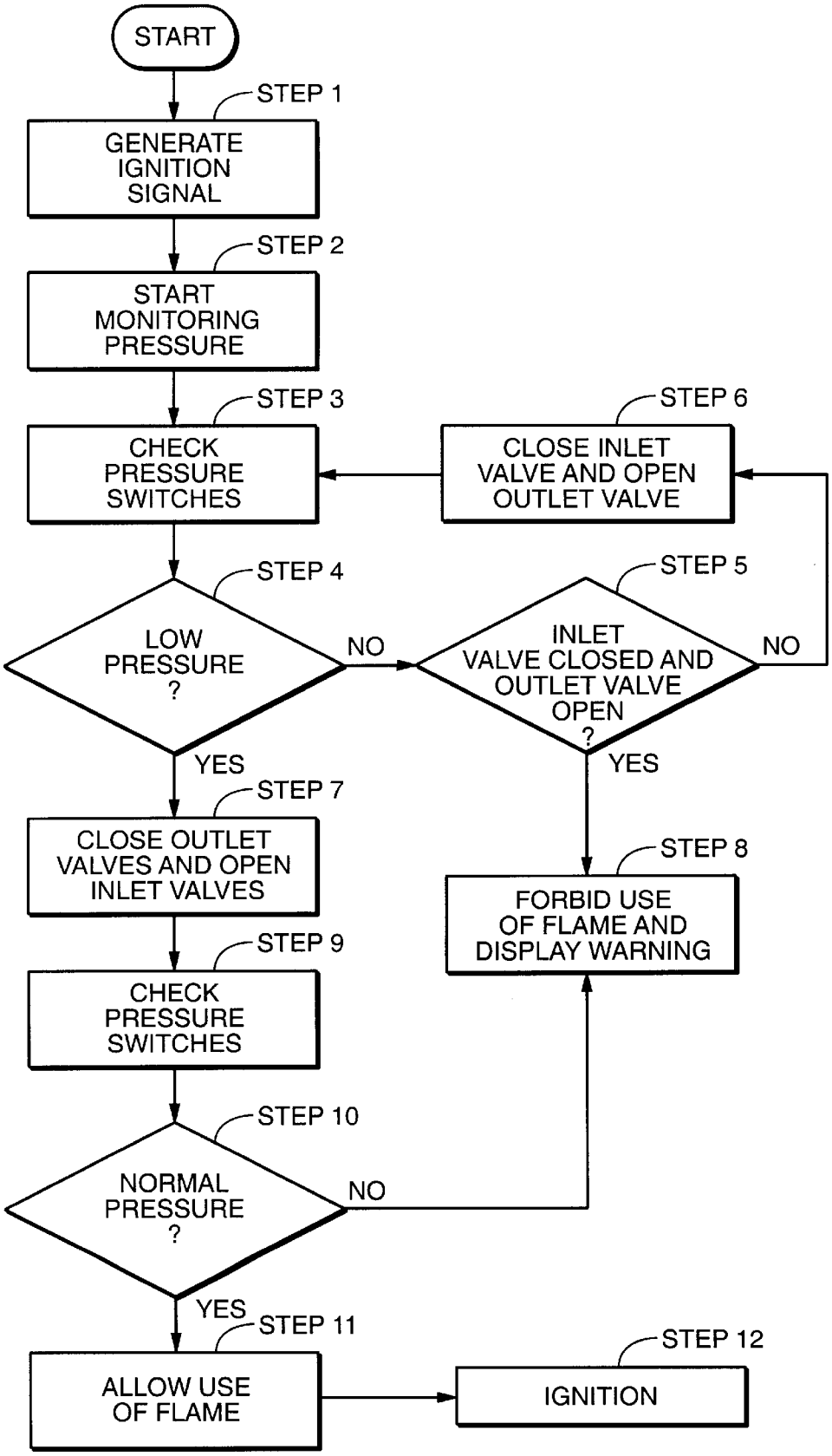
FIG. 2 is a flowchart of the operation of the atomic absorption photometer shown in FIG. 1.

For the operation of the photometer as described above, the microprocessor 1, operating according to a program preliminarily stored in the memory device 2, serves to control the electromagnetic valves 11 and 12 to thereby cause the combustion of a mixture of the combustion gas and the combustion improving gas through a burner 21. FIG. 2 shows an example of this program according to which the microprocessor 1 may be operated.

When the user operates the keyboard 6 to generate an ignition signal (Step 1) for the ignition of a mixed gas, the normal operating condition of the safety monitor is ascertained (Step 2) automatically by the photometer itself. The signal outputted from the pressure switch 14 for the combustion improving gas is transmitted through the input circuit 3 to the microprocessor 1. The condition of the pressure switch 14 is determined by this signal (Step 3). If it is ascertained that the pressure is not in a lowered pressure condition (NO in Step 4), the inlet valve 12 is closed and the outlet valve 16 is opened (Step 6), unless this is already done (NO in Step 5), to affirmatively create an unsafe low-pressure condition for igniting a flame. If the microprocessor 1 learns that this low-pressure condition is being recognized as an unsafe condition by the gas pressure monitor (YES in Step 4), this fact is stored as information in the memory device 2 and the supply of the combustion gas and the combustion improving gas is started by closing the outlet valves 15 and 16 and opening the inlet valves 11 and 12 (Step 7). If the microprocessor 1 learns that this low-pressure condition is not being detected (NO in Step 4) while the inlet valve 12 is closed and the outlet valve 16 is open (YES in Step 5), this is interpreted as being due to an error of the pressure switch 14, and this fact is recorded in the memory device 2 while an error message is displayed as a warning to the user on the display device 5 and the use of a flame is thereafter disallowed (Step 8).

The processes after Step 7 are the same as according to the prior art technology, ignition of a flame being allowed (Step 11) and the flame being formed (Step 12) if the pressure condition is checked (Step 9) and a normal pressure condition is ascertained (YES in Step 10). If the microprocessor 1 does not recognize that the output signal from the pressure switch 14 has changed from indicating the low-pressure condition to indicating a normal-pressure condition (NO in Step 10), this fact is stored in the memory device 2, a warning display is made on the display device 5 and the use of a flame is prohibited (Step 8).

If the user attempts thereafter to ignite at the burner 21, the microprocessor 1 allows or disallows the use of a flame according to the information stored in the memory device 2. If the microprocessor 1 disallows the use of a flame, it may also cause a warning signal to be outputted through the display device 5.

In summary, a safe condition can be ascertained according to this invention even though only one sensor is required.

Although the invention has been described above by way of only one example, this example is not intended to limit the scope of the invention. Many modifications and variations are possible within the scope of the invention. The routine for affirmatively creating an unsafe condition is carried out according to the illustrated example before each time a mixed gas is ignited but the operating system may be programmed such that this routine is carried out only as a part of the initialization routine because the sensor, after having once been started normally, seldom develops a malfunctioning during its normal operation.

What is claimed is:

1. An atomic absorption photometer comprising:

a combustion gas flow route through which a combustion gas is caused to flow;

a combustion improving gas flow route through which a combustion improving gas is caused to flow;

a burner for igniting a mixture of said combustion gas and said combustion improving gas transported respectively through said combustion gas flow route and said combustion improving gas flow route;

a combustion gas pressure switch for measuring pressure of said combustion gas in said combustion gas flow route;

a combustion improving gas pressure switch for measuring pressure of said combustion improving gas in said combustion improving gas flow route; and a microprocessor programmed to affirmatively create an unsafe condition for ignition at said burner by preventing said combustion improving gas from flowing into said combustion improving gas flow route, and to output a warning signal if said combustion improving gas pressure switch is found not indicating said unsafe condition in said combustion improving gas flow route.

2. The atomic absorption photometer of claim 1 further comprising a memory means for storing outputs from said microprocessor indicative of whether use of a flame is allowed or disallowed.

3. The atomic absorption photometer of claim 1 wherein said microprocessor is further programmed to check the pressure of said combustion improving gas in said combustion improving gas flow route after allowing said combustion improving gas to flow through said combustion improving gas flow route and to output a warning signal if said combustion improving gas pressure switch is found not to indicate a specified normal pressure condition in said combustion improving gas flow route.

4. The atomic absorption photometer of claim 2 wherein said microprocessor is further programmed to check the pressure of said combustion improving gas in said combustion improving gas flow route after allowing said combustion improving gas to flow through said combustion improving gas flow route and to output a warning signal if said combustion improving gas pressure switch is found not to indicate a specified normal pressure condition in said combustion improving gas flow route.

5. An atomic absorption photometer comprising:

a combustion gas flow route through which a combustion gas is caused to flow;

a combustion improving gas flow route through which a combustion improving gas is caused to flow;

a burner for igniting a mixture of said combustion gas and said combustion improving gas transported respectively through said combustion gas flow route and said combustion improving gas flow route;

a combustion gas pressure switch for measuring pressure of said combustion gas in said combustion gas flow route;

a combustion improving gas pressure switch for measuring pressure of said combustion improving gas in said combustion improving gas flow route;

condition-creating means for affirmatively creating an unsafe condition for ignition at said burner according to a specified program by preventing said combustion improving gas from flowing into said combustion improving gas flow route; and warning means for outputting a warning signal if said combustion improving gas pressure switch is found not to be indicating said unsafe condition affirmatively created by said condition-creating means in said combustion improving gas flow route.

6. The atomic absorption photometer of claim 5 further comprising a memory means for storing outputs from said warning means indicative of whether use of a flame is allowed or disallowed.

7. The atomic absorption photometer of claim 5 wherein said warning means also serves to check the pressure of said combustion improving gas in said combustion improving gas flow route after allowing said combustion improving gas to flow through said combustion improving gas flow route and said warning means serves to output a warning signal if said combustion improving gas pressure switch is found not to indicate a specified normal pressure condition in said combustion improving gas flow route.

8. The atomic absorption photometer of claim 6 wherein said warning means also serves to check the pressure of said combustion improving gas in said combustion improving gas flow route after allowing said combustion improving gas to flow through said combustion improving gas flow route and said warning means serves to output a warning signal if said combustion improving gas pressure switch is found not to indicate a specified normal pressure condition in said combustion improving gas flow route.

* * * * *